US005908035A

United States Patent [19]

Carroll et al.

[11] Patent Number: 5,908,035

[45] Date of Patent: Jun. 1, 1999

[54] ARTIFICIAL FINGERNAILS CONFIGURED FOR A FRENCH MANICURE

[76] Inventors: George H. Carroll, 853 Via Alondra, Camarillo, Calif. 93010; Arthur A. Krause, 20642 Skouras Dr., Canoga Park, Calif. 91306

[21] Appl. No.: 08/703,056

[22] Filed: Aug. 26, 1996

[51] Int. Cl.[6] ..... A45D 29/00

[52] U.S. Cl. ..... 132/73

[58] Field of Search ..... 132/73, 73.5, 285, 132/200, 76.4, 76.5, 319; D28/56, 62; 206/581, DIG. 823

[56] References Cited

U.S. PATENT DOCUMENTS

| | | | |
|---|---|---|---|
| D. 303,161 | 8/1989 | Tomkins | D28/56 |
| 1,135,382 | 4/1915 | Kindred | 132/73 |
| 2,633,139 | 2/1953 | Pettey | 132/73 |
| 2,746,460 | 5/1956 | Jellinek | 132/73 |
| 2,864,384 | 12/1958 | Walter | 132/73 |
| 3,750,684 | 8/1973 | Russell | 132/73 |
| 3,786,821 | 1/1974 | Noskin | 132/73 |
| 3,898,357 | 8/1975 | Miller et al. | 132/73 |
| 3,982,551 | 9/1976 | Bartolucci | 132/73 |
| 4,135,526 | 1/1979 | Matranga et al. | 132/73 |
| 4,408,622 | 10/1983 | Meyerhoeter et al. | 132/73 |
| 4,450,848 | 5/1984 | Ferrigno | 132/73 |
| 4,625,740 | 12/1986 | Roth | 132/73 |
| 4,718,957 | 1/1988 | Sensenbrenner | 132/319 |
| 4,805,645 | 2/1989 | Schiff et al. | 132/73 |
| 4,876,121 | 10/1989 | Cohen | 132/73 |
| 4,960,138 | 10/1990 | Kling | 132/73 |
| 5,070,892 | 12/1991 | Trematerra | 132/73 |
| 5,413,123 | 5/1995 | Aylott et al. | 132/73 |
| 5,513,754 | 5/1996 | Chang | 206/581 |
| 5,699,813 | 12/1997 | Carroll | 132/73 |

FOREIGN PATENT DOCUMENTS

| | | | |
|---|---|---|---|
| 288714 | 11/1988 | European Pat. Off. | 132/73 |
| 1183011 | 3/1970 | United Kingdom | 132/319 |

*Primary Examiner*—Todd E. Manahan
*Assistant Examiner*—Eduardo C. Robert
*Attorney, Agent, or Firm*—Page Lohr Associates

[57] ABSTRACT

Artificial fingernails and fingernail kits which are comprised of a plurality of pieces laminated together form a composite nail having a preferred look. A preferred look called "French Manicure" is obtained where the color scheme very accurately resembles the colors of a natural nail. Fingernails of the invention have a pink color visible through a white translucent material. The arrangement of the pieces which form the composite nail may include a structure where a first thin piece made of translucent material is attached to a second thin piece made of colored material. The composite nail may be attached in a conventional way to a natural nail or alternatively, the nail may be built-up, step-by-step onto a natural nail.

4 Claims, 4 Drawing Sheets

ARTIFICIAL FINGERNAILS CONFIGURED FOR A FRENCH MANICURE

BACKGROUND OF THE INVENTION

1. Field

The present invention is generally concerned with cosmetic products for human use and more specifically concerned with simulated or artificial fingernails configured in a "French Manicure" arrangement.

2. Prior Art

Fashion trends suggest preferred looks which may become particularly desirable from time-to-time. A popularly attractive look for a feminine hand typically includes long and slender fingers. In addition, well groomed fingernails may add considerable beauty to a woman's hand. It has long been a practice to prepare fingernails with cosmetic materials to enhance certain properties including length, shape and color.

With reference to the drawing FIG. 1, a hand is drawn clearly showing fingernails in various positions. In particular, the thumb 1, shows a 'top' view of a fingernail where a fingernail base 2 includes a lunula 3, and is adjacent to a fingernail tip 4. A side view of fingernails on other fingers further shows these fingernail parts in a different perspective. For example the forefinger 5 has a fingernail base 6 and a fingernail tip 7. A fingernail is attached to a finger at its underside in a region called a nailbed.

A natural human fingernail is generally comprised of material which is translucent and white in color. Where the fingernail is attached to the finger at the nailbed, the pink color of the finger flesh shows through the fingernail giving the fingernail a pink appearance in the nailbed region. The fingernail tip 4 appears white as there is no flesh attached therebehind. Sometimes, there is a small region (lunula) 3 of the nailbed near the cuticle which is crescent-shaped and white in color or a lighter shade of pink. Without application of colorants or other enhancement products, this is how a fingernail appears naturally.

Recently, a particular look called "French Manicure" has become quite popular. The French Manicure look is a prepared arrangement meant to appear very natural. It is most generally a scheme of two colors which cooperate together. A French Manicure has the base of a fingernail that is pink in color and the remaining portion, the tip of the fingernail, is white in color. This color scheme resembles the color pattern of a natural fingernail.

Presently, a popular way of providing a French Manicure color scheme as described is to paint the top surface of the fingernails in the appropriate colors. For a woman having naturally long fingernails, merely applying fingernail polish may be sufficient. Indeed, a significant array of products specifically designed to support the French Manicure look is available on the common market. A survey of a neighborhood drugstore revealed no fewer than five manufacturers offering at least seven kits used for preparation of nails in a French Manicure look. A kit typically consists of two colors of fingernail polish: a white color, and a pink or "nude" color. However, since fingernail polish is a mere coating applied to the top of ones fingernail, it is subject to damage from scratching, and smudging. Wear also tends to cause applied polish to appear bad after some time has past. An additional problem occurs in the application process. As the French Manicure look requires a transition between two colors in a precise way, it is difficult to get an even natural look with polish. The brushes used to apply the polish do not support the shape of the color transition. Shaking hands additionally complicate the objective. Additionally, pink polish on the surface of a fingernail does not appear the same as pink flesh visible through a natural nail.

Some techniques have been developed to assist a woman in painting the color transition from pink to white. A mask or guide may be provided to support painting a line transition between colors. FIG. 2A shows the end of a finger 21 to which a paper strip 22 prepared with an adhesive has been attached on the fingernail. A line is formed between the fingernail tip 23 and the fingernail base 24. By painting the nail and the strip as shown, the line defined by the edge of the strip is transferred to the nail color. A conventional nail polish brush 25 is used to apply white polish in a sweeping motion 26 toward the tip edge. After polish has been applied and sets a bit, the mask is removed. Finally, pink or nude polish is applied to the nail base 24 up to the line left by the form.

This technique suffers from the unnatural look as a result of the transition between colors which is formed on the top surface of the nail. The transition in a real nail occurs below the nail surface, and may appear more smooth. A painted line may sometimes leave a surface having ridges which is not smooth and sometimes requires an additional clear top coat. The two colors of polish may form a ridge at the transition which causes an undesirable appearance. Applying polish with a form tends to result in an inferior looking finish.

A very popular technique for dressing fingernails includes the application of acrylic material to the natural nail. A natural fingernail may be enhance with the acrylic material to form a longer more beautiful fingernail. Using acrylics of different colors, skilled manicurists readily prepare acrylic fingernails in a manner which provides the French Manicure look. Acrylic material is applied to a fingernail in liquid form which quickly hardens to build-up a longer and thicker fingernail. A first portion of the acrylic fingernail is formed at the base in pink acrylic and second portion is formed in white translucent acrylic. The two portions are blended together such that the transition forms a curved line as found on natural fingernails. When the acrylic material sets, the color is held giving the desired pattern.

For an application of acrylic material to appear natural, it takes great care and attention to detail. Small mistakes may require considerable time to repair as cured acrylics are quite hard and may need to be replaced entirely. As applying acrylic to ones own fingernails can be quite difficult, the task to make a natural French Manicure look can be particularly challenging. There are additional circumstances which make application of acrylic material less than favorable when trying to create a French Manicure look. Consequently, other techniques for dressing fingernails in a French Manicure have been developed.

Artificial fingernails are typically plastic pieces in the shape of a natural fingernail which can be glued or otherwise attached to a real fingernail. Simulated fingernails are formed in a mold and come in many sizes. They are usually white in color and can be painted to many desired finishes. Alternatively, they may consist of colored plastic and not require application of any fingernail polish. When a user of artificial fingernails desires to wear the French Manicure look, they can choose from painting the fingernails as described above or they may purchase specially prepared fingernails which may have colors applied when they are manufactured. A manufacturer of artificial fingernails may mold the plastic in a white colored material and later apply a pad printing process. The pad printing process is useful for applying a printed pattern to the irregularly shaped surface of an artificial fingernail. This printing process adds cost to the final product and suffers from similar problems relating to wear, fading and scratching.

Notwithstanding, techniques and devices have been discovered which provide very novel uses of artificial fingernails, particularly an arrangement of an artificial fingernail having the French Manicure look where a natural color-through-translucent effect is preserved.

While the systems, techniques and inventions of the prior art are designed to achieve particular goals and objectives, some of those being no less than remarkable, these inventions have limitations, undesirable effects, and defects which prevent their use in new ways now possible. These prior techniques are not used and cannot be used to realize the advantages and objectives of the present invention.

SUMMARY OF THE INVENTION

Comes now, George H. Carroll and Arthur A. Krause with an invention of artificial fingernails including devices and methods of providing a French Manicure look where the color scheme remains very true to nature.

The French Manicure look is meant to give well groomed fingernails a beautifully natural appearance. As described above, the color scheme which appears on a natural fingernail is the foundation for the look of a French Manicure.

It is a primary function to provide simulated fingernails having a French Manicure look. It is a contrast to prior art methods and devices that present systems are not subject to the wear and damage of previous devices. It is a contrast to prior art methods and devices that present systems preserve pink-under-translucent white look. A fundamental difference between fingernails of the instant invention and those of the art can be found when considering its color arrangement where a pink colored portion shows through a white translucent portion to provide a very realistic and natural look.

Fingernails of the invention are primarily characterized by arrangements which provide for a color to be visible through a translucent material thereby creating a realistic and natural look. Some versions may be more particularly characterized by having two piece laminate structure. A first shaped piece fits matingly into a second shaped piece having a receiving cavity therein. The first piece may be molded from pink plastic material and the second piece may be molded from a white plastic material. The pieces can be bonded together with glues, cements or other conventional ways of securing plastics together. The pieces when affixed together are in the shape of and form a simulated fingernail which can be used in the traditional way. When the fingernail is attached to a real fingernail, the pink piece is only visible through the translucent white piece. This gives a very pleasing look and appears as a natural fingernail bed may appear through a real fingernail in a French Manicure configuration. The combination is durable, pleasing to the eye, safe, inexpensive, and simple.

OBJECTIVE OF THE INVENTION

It is a primary object of the invention to provide a artificial fingernail.

It is an object of the invention to provide a artificial fingernail which provides a French Manicure look.

It is an additional object of the invention to provide a composite artificial fingernail of more than one portions where a first portion is pink and a second portion is translucent white.

It is a further object to provide an artificial fingernail having a color applied to the underside thereof.

It is an object of the invention to provide a simulated fingernail having a pink portion showing through from a white translucent portion.

It is a further object of the invention to provide a simulated fingernail of more than one piece which is laminated together.

A better understanding can be had with reference to the detailed description of Preferred Embodiments and with reference to the appended drawings. These embodiments represent particular ways to realize the invention and are not inclusive of all ways possible. Therefore, there may exist embodiments that do not deviate from the spirit and scope of this disclosure as set forth by the claims, but do not appear here as specific examples. It will be appreciated by experts in the cosmetics fields that a great plurality of alternative versions of the invention are possible.

BRIEF DESCRIPTION OF THE DRAWING FIGURES

These and other features, aspects, and advantages of the present invention will become better understood with regard to the following description, appended claims and drawings where:

PREFERRED EMBODIMENTS OF THE INVENTION

In accordance with each of the preferred embodiments of the invention, various versions of apparatus and kits are provided. Although some versions may be better than others under various circumstances, each will be found to be within the spirit and scope of the invention which can be readily appreciated from the appended claims. Certain preferred embodiments described here may have aspects and features which might not be found in all embodiments. Consequently, one must look to the claims to find the true breadth of the invention. This following description sets forth best modes of executing the invention which are contemplated by the inventors. The careful reader will appreciate that some limitation described here may not necessarily be found in all versions and embodiments possible.

The invention is particularly characterized by a fingernail of two or more colors where a first color appears through a translucent second color. Fingernails of the invention are therefore configured in layers of different colors such that one layer is visible through another. When a pink colored layer shows through a translucent white layer, the artificial fingernail appears quite natural.

There are at least three preferred ways to arrive at the final result. A first way includes applying a colored polish to ones natural fingernail prior to applying a white translucent artificial nail. A second is to merely paint a portion of the underside of an appropriately shaped artificial fingernail of white translucent plastic before affixing it. A third technique includes a laminate, two-piece fingernail. In each case, the base of the artificial nail is carefully prepared to allow the proper amount of color to show therethrough. Of the three versions the best results have been achieved in two piece laminate structures. A detailed description of each configuration follows here.

Molded plastic artificial fingernails are generally single piece elements. However, it is possible to form them of a plurality of pieces. For example, two pieces may be formed such that they fit matingly together. A two piece configuration provides additional freedom in the molding process with respect to choices of color. Namely, a first piece may be made of white translucent plastic and a second piece may be made of pink opaque plastic. When fitted together, the combination may form a single composite fingernail of two colors such that the pink color of the second piece shows through the translucent white material of the first piece. In this way, a very special color scheme is realized, the scheme being highly realistic and thus preferred over alternative fingernails which tend to want a more natural look.

Two Piece Construction

Figure 1:
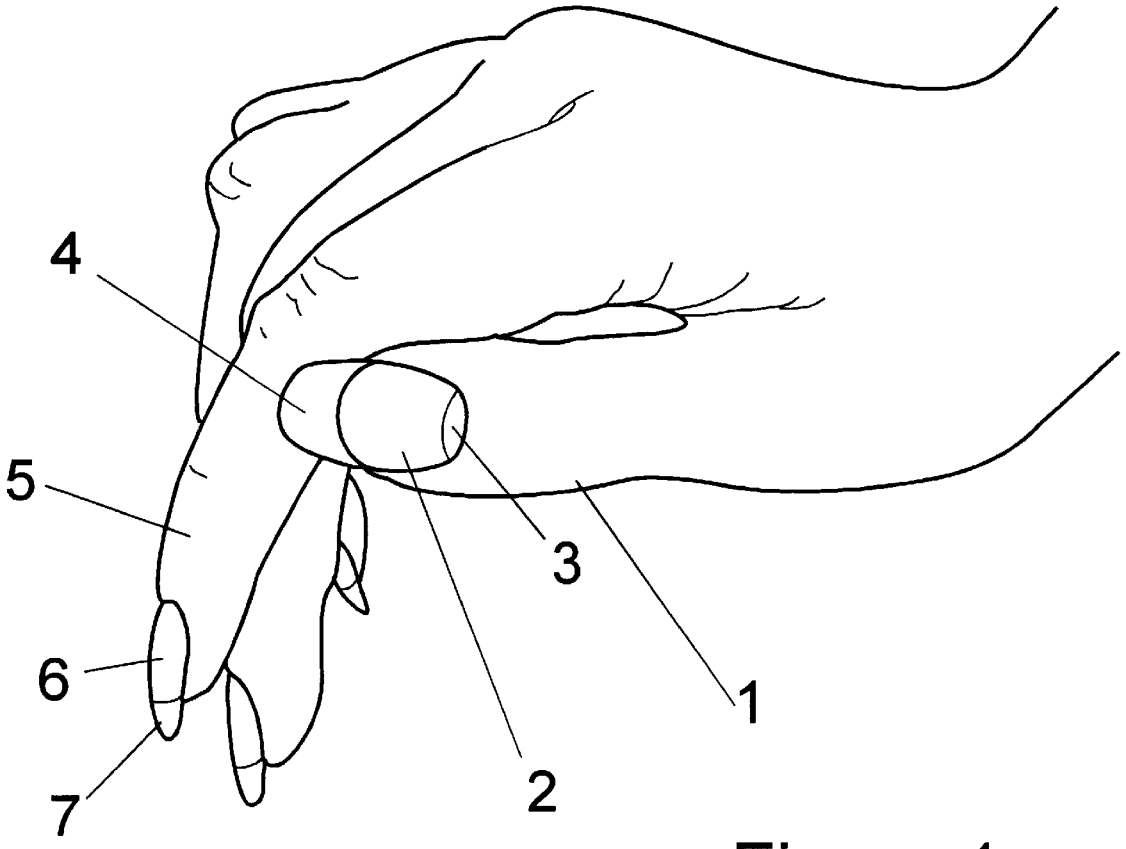
FIG. 1 shows a hand with fingernails positioned on fingers thereof.
Figure 2A:
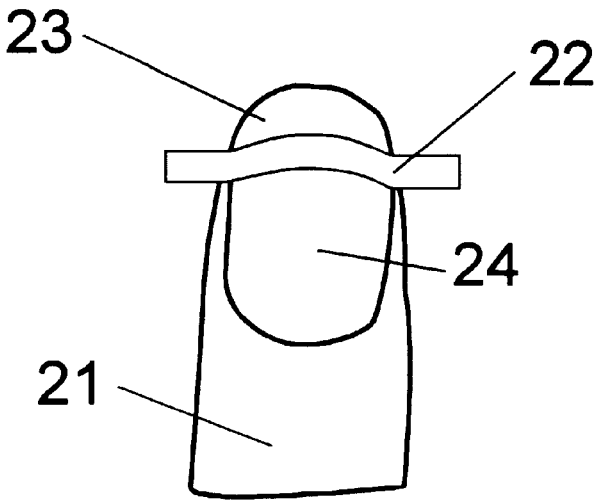
Figure 2A Prior Art
FIGS. 2A through 2C are illustrations of prior art methods for painting a French Manicure pattern onto a fingernail.
Figure 2B:
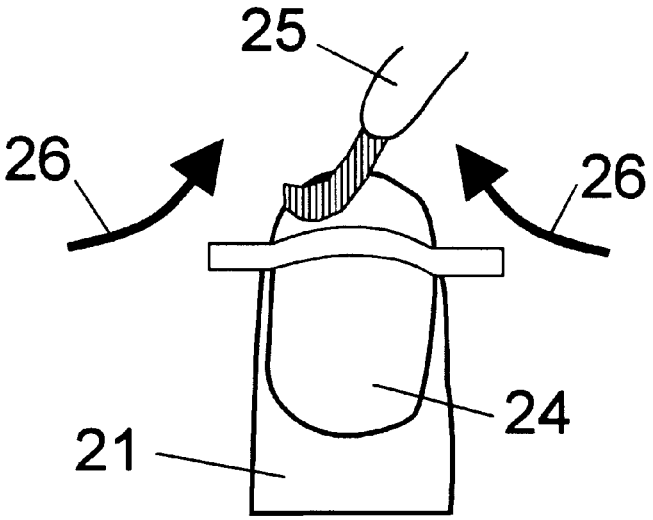
Figure 2B Prior Art
Figure 2C:
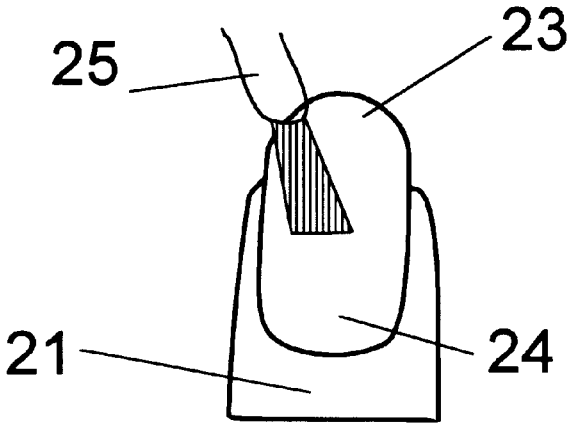
Figure 2C Prior Art
Figure 3:
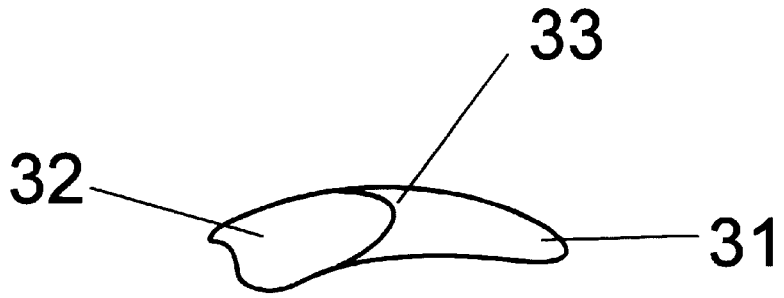
FIG. 3 is a fingernail drawn in a perspective view.

Examples of two piece constructions are illustrated in the drawing figures accompanying this written description. With reference to FIG. 3, an artificial fingernail is shown in a perspective drawing. The fingernail may be comprised of a fingernail tip 31 portion and a nailbed portion 32 which meet together along a curve 33. The line where the tip and base meet may be of various shapes, but is generally simply curved to resemble part of the periphery of a natural nailbed. In some alternative versions of the French Manicure look, one may want a more distinctive chevron appearance. Accordingly, the invention fully includes the various alternative shapes of the transition between the fingernail tip and the nailbed which may come into fashion from time-to-time.

Figure 4:
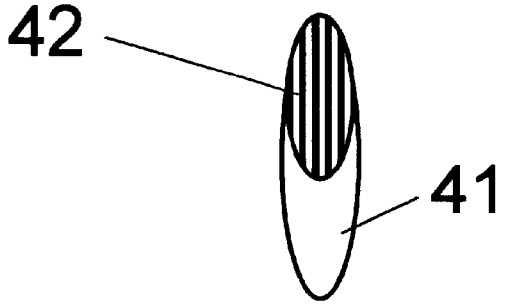
FIG. 4 is a simplified top view of a fingernail showing a first portion which represents a nailbed.

FIG. 4 shows a simplified geometric configuration for an artificial fingernail in a French Manicure arrangement. A first piece 41 is oval shaped and is affixed to a second piece 42 which is also oval shaped. The stippling associated with the second piece 42 indicates a pink color. The first piece may be preferably constructed of a white translucent material. These two pieces are affixed to one another to form the desired color scheme which resembles a natural fingernail. However, the two piece construction is not necessarily complete when these two elements are simply combined. The combination is greatly improved when considering a specialized arrangement for combining the two parts. The arrangement supports the objectives of the French Manicure look in a superior way and results in a very attractive final product which has benefits which cannot be found in other devices and methods. The arrangement is characterized by the colored piece being attached to the translucent piece at its underside surface where it is put in intimate contact therewith. Provided the thickness of the translucent piece is well designed, the colored piece shows through the translucent piece yielding a perfect French Manicure look.

Figure 5:
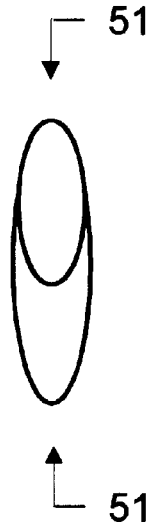
FIG. 5 shows a cross section line "A" along the longitudinal axis of a version of an artificial fingernail of the invention.
Figure 6:
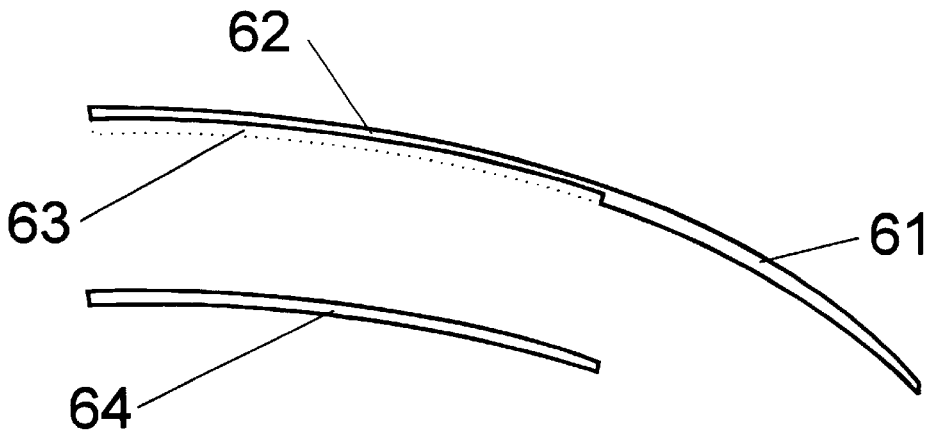
FIG. 6 shows a lateral cross section view of an artificial fingernail of the invention.

If a cross section region along a longitudinal axis is considered, one will more readily understand the following description of the arrangement which forms the essence of the preferred embodiments of the invention. FIG. 5 shows a longitudinal axis "A51" of particular interest. If the fingernail were cut along this axis, then the arrangement can be envisioned in its best profile. FIG. 6 shows a fingernail in lateral cross section as indicated by the axis "A51" of FIG. 5. The first piece appears above the second piece. The first piece has a fingertip portion 61 and a base portion 62. The base is additionally comprised of recess portion 63 which has a boundary partially indicated in the figure by a dotted line. The recess is additionally bounded by the periphery of the base portion 62. The second piece 64 is shaped to fit matingly into the recess of the first piece to form an integral unit.

Figure 7:
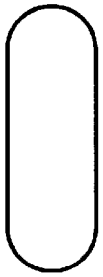
FIG. 7 is a top view of a fingernail showing a generally oval shape used in some preferred versions.
Figure 8:
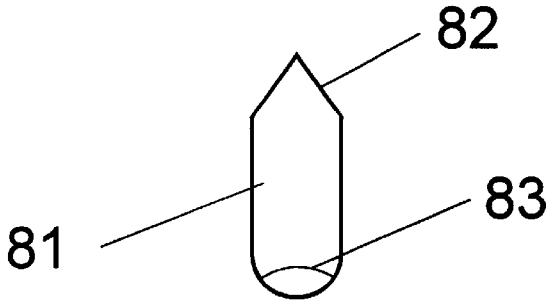
FIG. 8 shows an end view where the longitudinal cross section is generally concave down.
Figure 9:
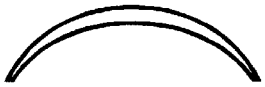
FIG. 9 illustrates an example of an alternative shape which may be employed without deviating from the essence of the invention.

The amalgamation described above is not specific to any particular shape of the second piece. However, it is best when the shape of the cavity matches the shape of the piece to be inserted therein. As will be readily appreciated in the drawing figures, particularly FIGS. 7 and 8 which show top views of versions of second pieces. FIG. 7 shows a substantially oval shape which is considered one of the simplest forms. The shape of the receiving cavity should also be an oval which is slightly bigger in order to accommodate the colored piece. FIG. 8 shows an advanced version of a colored piece 81 having additional features. The end to be aligned nearest the fingernail tip 82 can take a chevron shape or other artful design. The opposite end might be painted with a light color to form a lunula 83 which may show through the translucent material giving a very complete finish. Neither the top view nor lateral cross section shown in FIG. 6 show the shape of the pieces in a longitudinal cross section. FIG. 9 shows that the nails of the invention take a conventional shape, i.e. downwardly concave, in this regard. Of course, the degree and exact shape may be highly variable without losing the objectives of the teachings here. In the general case the nail may be as show. Exceptional cases will include other configurations.

It is important to consider the thickness of the fingernail pieces at various points. Referring again to FIG. 6, in the tip region the thickness of the fingernail is preferably about twenty thousandths of an inch. For the plastic materials which are well suited for use as artificial fingernails, twenty thousandths gives a good natural feel and resembles the thickness of real fingernails while providing sufficient strength. The fingernail may taper a bit in thickness towards the extremity of the fingernail tip. The fingernail base of the composite fingernail is also preferably about twenty thousandths of an inch thick. Accounting for any bounding agents which may be used to affix one piece to another suggests that individual pieces be slightly less than ten thousands of an inch thick.

In order to provide different degrees of color transmission through the top first piece, it may be made thinner while the second piece be made thicker. A thinner first piece will make the color of the second piece more visible. It is not always possible to make the first piece thinner due to strength considerations. However, the degree to which the material is translucent may be varied by appropriate selection of plastics. A more transparent plastic may be made thicker without loosing transmission of color therethrough.

Of course, it is quite possible to make the thickness vary over a considerable range. The specified thickness above tends to support well best properties of this preferred embodiment. Should one choose different plastics or different base materials which might be stronger for example, then the thickness might better be specified slightly thinner. The exact thickness will not cause the function and advantages of the invention to change and therefore the invention does not rely on any precise thickness for enablement.

Alternatives Having Only One Piece

A very useful alternative version is possible without the use of two piece structures. If a natural fingernail is well prepared in shape and color then it may serve to replace the colored piece in the two piece version. The natural nail should be shaped as close as possible to the shape of the receiving cavity of the white translucent layer. Merely attaching a white translucent piece to the colored natural nail will create the desired French manicure look. Since the base portion of the artificial nail must operate to allow the color to be visible therethrough it is usually quite thin. Therefore, in order to achieve sufficient strength, the plastic used to form the piece must be particularly strong. This arrangement of a single piece in combination with a colored natural nail serves well the objective of providing a colored material which is visible through a translucent material in the shape of an artificial fingernail.

Finally, a third useful technique and device for arriving at another version of the invention includes an artificial fingernail of white translucent material having on its underside surface a portion operable to receive an application of color, for example fingernail polish. After fingernail polish is applied to the artificial nail and is allowed to dry, the prepared fingernail can be affixed to the natural nail in a conventional way. This technique is further improved by use of colored adhesives. The step of applying color to the underside surface can be omitted if a properly prepared artificial fingernail is attached to a natural nail with an adhesive which has been augmented by addition of a colorant or coloring agent. The adhesive or glue engages the underside surface of the white translucent fingernail to provide the desired color as well as serving to attach the artificial nail to the natural fingernail. The adhesive then becomes the "colored material" which is visible through a translucent material in the shape of an artificial fingernail. In some configurations of the invention, it is desirable to include a kit of artificial fingernails of various sizes and shapes whereby the pieces are translucent and the kit comprises paint, polish or colorant. Kits may also be arranged to include artificial finger nail pieces of various sizes and shapes comprising pieces belonging to two groups and a kit including pieces in sizes which correspond to the various sizes of the fingers of an average hand. Finally, a kit may be arranged to include pieces in chevrons, ovals and crescents and a kits may further includes glue, instruction, files, and sandpaper.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

Applicants hereby claim as their exclusive property:

1. An artificial fingernail, comprising material of two colors, a first color being translucent whereby a second color may be transmitted therethrough, further comprised of at least two pieces, a first piece formed of rigid translucent white material having a top surface and a bottom surface; and a second piece formed of a rigid colored material having a top surface, the top surface of said second piece being affixed to the bottom surface of said first piece whereby the color of said second piece is transmitted through said first piece, the first piece having a cavity suitably shaped to matingly receive the second piece therein whereby the second piece is held affixed to the first piece and the color of said second piece is transmitted through said first piece.

2. An artificial fingernail of claim 1, where said first piece is comprised of a tip portion and a base portion, said tip portion being about twenty thousandths of an inch thick, said base portion being about ten thousandths of an inch thick; and where said second piece is about ten thousandths of an inch thick.

3. An artificial fingernail of claim 2, said first piece includes ridge along a transition from the tip portion to the base portion for mating with the second piece.

4. An artificial fingernail of claim 1, said second piece having two ends, one end being in the shape of a chevron.

* * * * *